US005852883A

United States Patent [19]

Ziglar et al.

[11] Patent Number: 5,852,883

[45] Date of Patent: Dec. 29, 1998

[54] CONCEALABLE DRYING BAR FOR CLOTHES HAMPER

[76] Inventors: Paul Ziglar, 6268 108th Ave., Burlington, Iowa 52601; Stephen A. Fausel, 35 Park Dr., Wapili, Wyo. 80450

[21] Appl. No.: 566,260

[22] Filed: Apr. 23, 1996

[51] Int. Cl.[6] ..... F26B 9/00

[52] U.S. Cl. ..... 34/621; 34/91; 34/202; 34/622; 220/403; 220/409

[58] Field of Search ..... 34/91, 202, 621, 34/622, 239, 240; D32/36, 37; 312/211, 287, 328; 220/403, 404, 409, 400

[56] References Cited

U.S. PATENT DOCUMENTS

| | | | |
|---|---|---|---|
| 2,156,184 | 4/1939 | Koski | 34/621 |
| 2,253,475 | 8/1941 | Willber | 34/621 |
| 5,253,775 | 10/1993 | Gould | 220/403 |
| 5,330,263 | 7/1994 | Wilkinson | 312/328 |

*Primary Examiner*—Henry A. Bennett
*Assistant Examiner*—Pamela A. Wilson

[57] ABSTRACT

The conceable drying bar for a clothes hamper provides a simple mechanism to receive and suspend wet or damp towels of clothing externally of the hamper structure.

3 Claims, 1 Drawing Sheet

CONCEALABLE DRYING BAR FOR CLOTHES HAMPER

BACKGROUND OF THE INVENTION

The art of providing a support for damp clothing or towels so that they may be exposed to the ambient air and moisture may evaporate from such clothing or towels is well developed.

Prior art discloses a variety of towel racks which may be attached to walls, see Parks U.S. Pat. No. 509,242, or cabinets, see Seymore U.S. Pat. No. 5,215,201 or that may telescope out, see Patterson U.S. Pat. No. 1,587,675, to provide extended support surfaces or may fold out from the surface mount portion, see Sieverson U.S. Pat. No. 2,434, 891, so as to reveal one or more racks upon which one may hang damp items. Such devices may even be installed in various parts of die household. such as the kitchen or bathroom, where one is likely to generate the items of damp clothing or wet towels.

Such items of prior art are often made so that they can fold or unfold or retract to a stored position. Such towel rods are often made of metal which must be coated so as to guard against rust. Because of the intricate moving parts or because they are made from metal all prior art is usually expensive to manufacture and often difficult to install in the desired location.

Mounting the prior art at the desired location also presents an additional problem for the user as there must be sufficient wall or cabinet space to receive that prior art and a fastening mechanism such as screws or nails must be used to attach the prior art at the desired location.

SUMMARY OF THE INVENTION

One object of the invention is to provide a simple mechanism to receive and suspend wet or damp towels or items of clothing so that they may air dry. A further object of the invention is to provide such mechanism in conjunction with a clothes hamper which will ultimately receive the damp article after drying and hold such article prior to the laundering of the item.

It is a further object of the invention to accomplish the foregoing with an easily manufactured item that is economical to reproduce.

An additional object of the invention is to provide such mechanism so that it can be concealed when not in use so that it is removed from posing an obstruction to the area in which it is located.

These and other objects of the inventive value of the concealable drying bar for clothes hampers being disclosed herein will become apparent from the drawing and specifications.

DETAILED DESCRIPTION OF THE PREFERRED EMBODIMENTS

Figure 1:
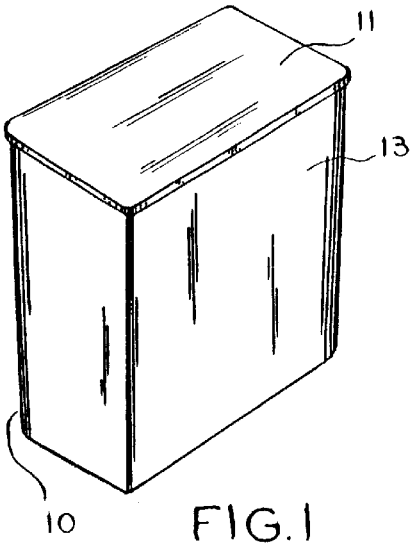
FIG. 1 is a front view of a clothes hamper which contains the inventive device which is retracted and stored.
Figure 2:
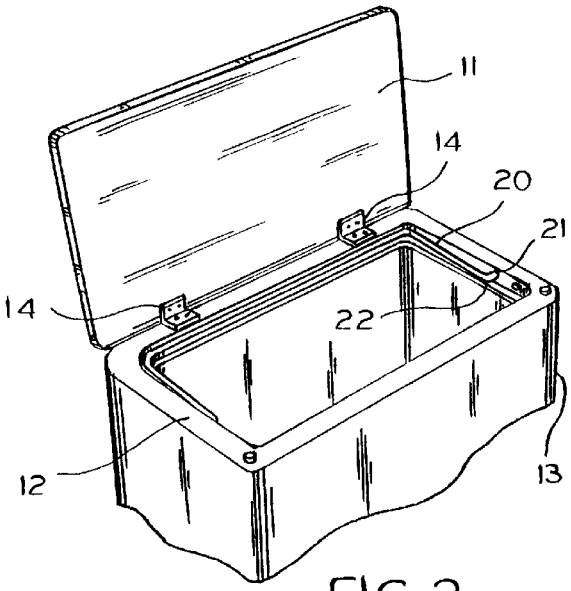
FIG. 2 is a front plan view of the device as it appears in its stored position beneath the lid of the associated clothes hamper.
Figure 3:
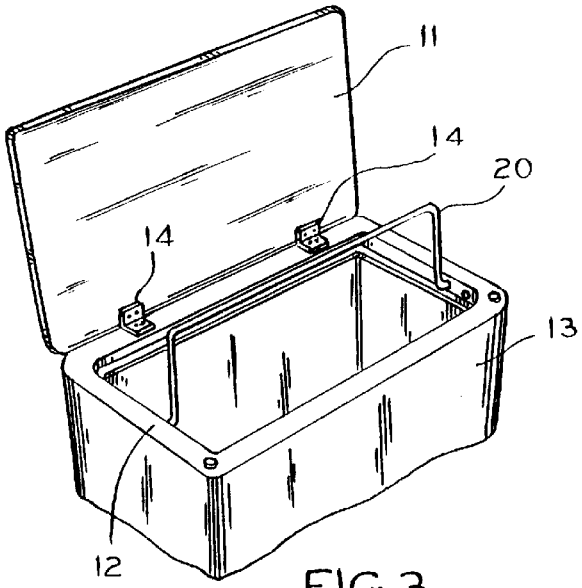
FIG. 3 is a top plan view showing the inventive device rotated midway between its stored position and its in use position.
Figure 4:
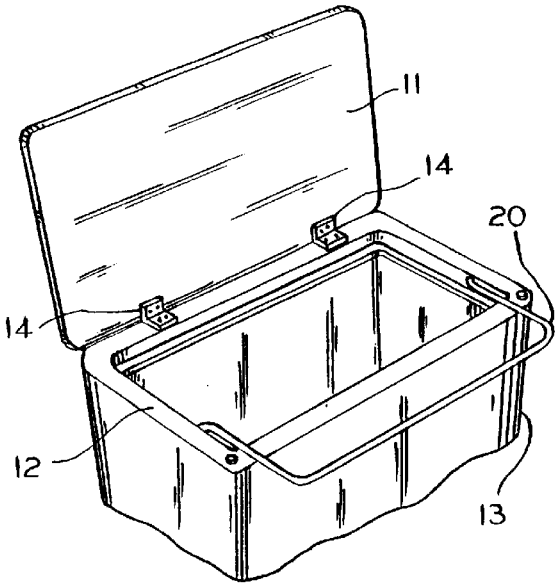
FIG. 4 shows the inventive device fully rotated to its in use position.
Figure 5:
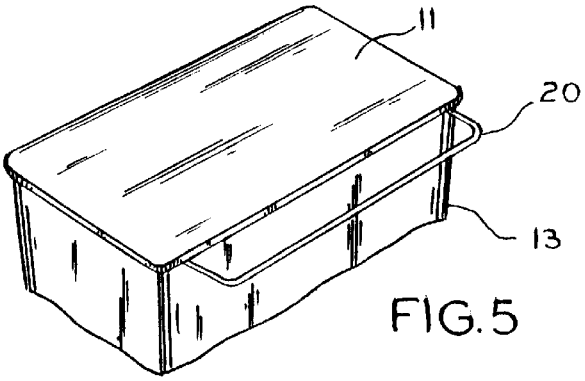
FIG. 5 shows the inventive device positioned and ready to receive articles for drying.

A concealable drying bar for clothes hampers is provided as shown from FIGS. 1 and 2 wherein a clothes hamper 10 is provided consisting of the hamper lid 11 mounted by hinges 14 to the rim of the hamper 12 and extended body 13. However the rim 12 of the hamper 10 is improved with a U-shaped towel bar 20 which has on each end a further flange 22 which fits into opening 21 on opposing sides of the rim 12 such that the U-shaped bar 20 may freely rotate as shown in FIGS. 3 and 4 along the axis line between openings 21 so that in one position it extends beyond the lip of rim 12 and rod 20 provides a surface from which one may hang damp towels or articles of clothing. Such rod 20 is supported by lip 12 and may allow the lid 11 of the hamper to close over the rod 20 as shown in FIG. 5, The rod 20 may also be rotated to a stored position as shown in FIG. 2 such that the rod may in one embodiment be functionally held against the inside of rim 12 or in another embodiment the rod 20 is received by a groove 15 formed in rim 12.

Although only a preferred and alternate embodiment have been discussed it is readily apparent that the functional equivalent of these embodiments may he made by those who are skilled in the art and that such changes made in the structure forming the inventive device do not depart from the spirit and scope of the inventive device.

We claim:

1. A laundry hamper comprising a rim and a suspension means whereby said suspension means may be rotated to a position outside of the hamper rim to receive towels and clothes and said means may be rotated to a storage position inside of the hamper rim.

2. The device of claim 1 wherein the suspension means further comprises a U-shaped rod which is rotatably mounted on the inside of the hamper rim whereby when said means is rotated to a storage position inside of the hamper rim, the suspension means is supported by a flange.

3. The device of claim 1 wherein the suspension means may be rotated to a storage position inside of the hamper rim and received in a groove along the rim of the hamper.

* * * * *